United States Patent [19]

Hutflesz

[11] 4,189,336

[45] Feb. 19, 1980

[54] METHOD OF FORMING PILE PRODUCTS BY TACK-SPINNING AND HEAT TREATMENT THEREFORE

[75] Inventor: Heather E. Hutflesz, Angelbachtal, Fed. Rep. of Germany

[73] Assignee: Imperial Chemical Industries Limited, London, England

[21] Appl. No.: 839,569

[22] Filed: Oct. 5, 1977

[30] Foreign Application Priority Data

Oct. 7, 1976 [GB] United Kingdom ..... 41715/76

[51] Int. Cl.[2] ..... D04H 11/00; B32B 5/00

[52] U.S. Cl. ..... 156/72; 26/2 R; 28/159; 264/164; 264/230; 264/243; 264/284; 264/345

[58] Field of Search ..... 156/72, 435, 272; 264/230, 235, 234, 284, 345, 346, 164, 243; 28/159, 214; 26/2 R; 8/152

[56] References Cited

U.S. PATENT DOCUMENTS

| | | | |
|---|---|---|---|
| 3,567,548 | 3/1971 | Miller | 156/72 |
| 3,644,954 | 2/1972 | LeGrand | 26/2 |
| 3,983,278 | 9/1976 | Wardle | 264/164 |
| 4,070,875 | 1/1978 | Kutz | 26/2 R |

*Primary Examiner*—Michael W. Ball

*Attorney, Agent, or Firm*—Cushman, Darby & Cushman

[57] ABSTRACT

A method for increasing the depth of a tack-spun thermoplastic pile on a backing layer comprises space heating the pile side of the product for a time and temperature less than that at which the pile collapses, said temperature being between the glass rubber transition temperature but above ambient and the temperature at which the pile collapses, using a heat source not in contact with the pile, and subsequently cooling the pile to ambient temperature.

11 Claims, 3 Drawing Figures

METHOD OF FORMING PILE PRODUCTS BY TACK-SPINNING AND HEAT TREATMENT THEREFORE

The present invention relates to the production of pile surfaced products.

It has already been proposed to produce a pile on the surface of a synthetic polymeric material by pressing the material against a heated surface, preferably a heated roll, and separating the material from the surface while cooling the material to below its softening point. In this way fibrils are drawn out from the surface of the sheet and the cooling action ensures that the major part of each fibril remains integral with the polymeric material. This technique is hereinafter referred to as tack-spinning. In the preferred mode of operation of this technique the polymeric material is a thermoplastic and cold air or another cooling medium is blown into the nip formed between the heated roll and the thermoplastic material as the thermoplastic separates from the roll. In this type of process it has also been proposed in UK patent specification Nos. 1378638, 1378639, 1378640, 1451311, 1451312 and 1451313 to feed the thermoplastic to the roll together with a backing web with the thermoplastic between the heated roll and the backing so that the thermoplastic softens and one side bonds to the backing web under the influence of the heated roll whilst the fibrils are drawn out from the other side of the thermoplastic. In a further process it has been proposed in UK patent specification 1334672 to produce a pile on a backing by drawing fibrils through a perforated screen such as, for example, a loosely woven cotton followed by stiffening of the screen. These techniques produce laminar materials consisting of the pilous synthetic polymeric material bonded to the backing.

In UK patent specification No. 1399821 a method of embossing tack-spun pile surfaced products is described in which the thermoplastic pile is collapsed in selected areas by application of heat preferably above the melting point of the thermoplastic material to the areas of the pile where collapse is required. The embossing may be achieved for example by use of a heated embossing roll or by heating selected areas using for example a stencil; the pile may be collapsed by heating the pile side or or from the reverse side. Embossing may also be achieved by the method described in UK patent specification No. 1451322 in which the tack-spun pile-surfaced product is deformed between two co-operating, intermeshing surfaces. In this process the pile remains essentially unchanged and the backing sheet is permanently deformed.

In UK patent specification No. 1472405 tack spun pile surfaced product having a backing web is heated from the back after completion of the tack spinning process at a temperature insufficient to cause collapse of the pile so that abrasion resistance of the pile and adhesion of the pile to the backing is improved. The pile is said to retain its original feel, texture and appearance.

In producing a pile surfaced product by the tack spinning processes hereinbefore described, the pile may deformed e.g. inclined and not vertical because of the direction it is parted from the heated surface. This inclination is particularly noticeable where the pile is less than 1 cm in depth and when the angle of inclination of the pile from the vertical is more than 10°. It has now been found that the pile depth may be increased if the pile surfaced product is heated after completion of the tack spinning process.

According to the present invention, a method is provided for increasing the depth of the pile of a pile surfaced product made by a tack-spinning process, the product having a pile of a thermoplastic material, said method comprising space heating the pile side of the product. Hence in accordance with the present invention the pile surfaced product has a pile depth greater than that before the present process. The products will therefore in general have greater resilience because, whilst the pile density remains essentially unchanged, the pile depth is increased so giving greater compressibility.

Figure 1:
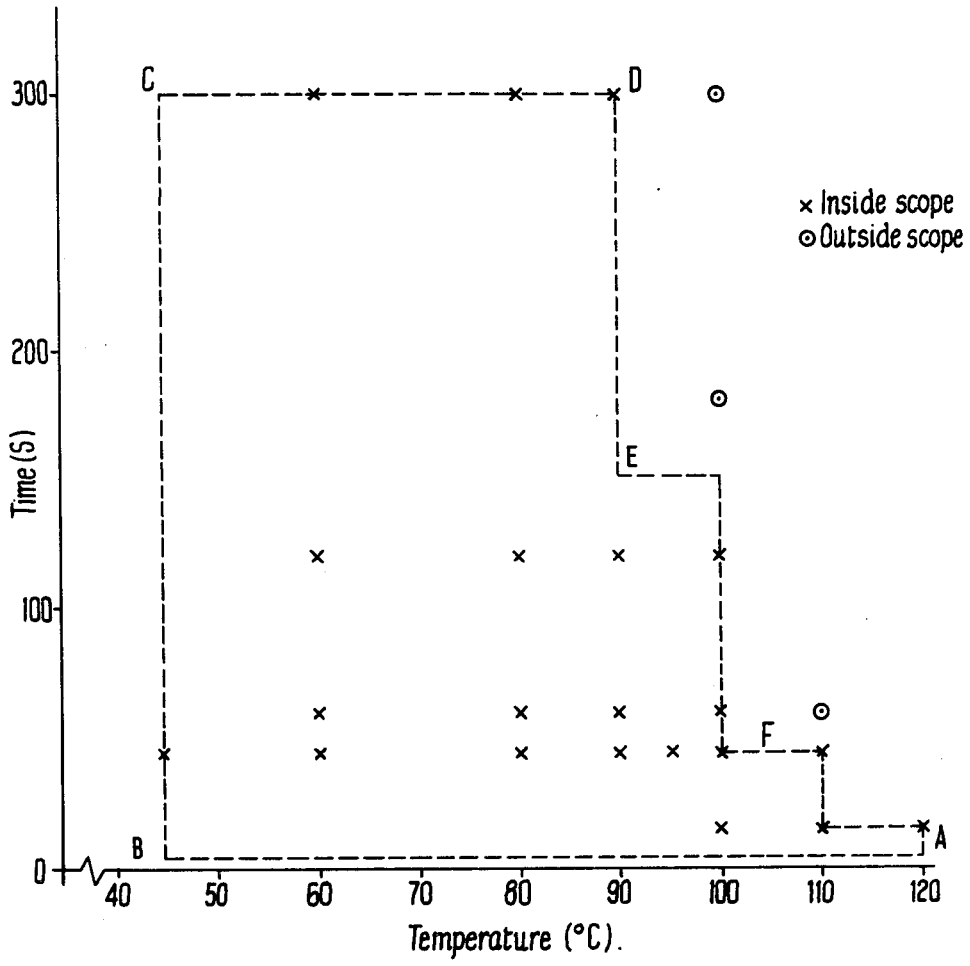
FIG. 1 is a graph showing time and temperature exposure combinations falling within the scope of the present invention for a sample taken from the inner layers of the rolled pile of example 1.

The process of the present invention may also have one or more of the following properties:

1. Improves depth of colour
2. Improves reduction to linting
3. Improves pancaked product In storing a roll of tack spun material and in rolling up the material, the pile is deformed by being subjected to compressive forces which tend to flatten or pancake the pile. A pile so flattened or pancaked may be at least partially restored to its original depth in accordance with the process of the present invention.

The process of the present invention is particularly suitable for the treatment of pile surfaced materials which have been obtained by pressing a sheet of a thermoplastic material against a heated surface so that the face of the thermoplastic material against the heated surface is molten and then withdrawing the sheet from the surface so that fibrils are drawn out from the thermoplastic material. In this type of process a backing substrate for the pile may conveniently be provided by feeding either an already formed laminate of the thermoplastic and the backing material to the heated roll or alternatively the thermoplastic film and the substrate may be fed separately in such a way that the heated surface melts the whole of the thermoplastic sheet and bonds it to the backing substrate. In all of these processes it is preferred that the pile be cooled as it is formed by the separation of the thermoplastic material from the heated surface. These types of process are described in UK patent specification Nos. 1378638, 1378639 and 1378640.

The texture and length or depth of the pile may readily be determined by careful control of the angle at which the material is withdrawn from the heated surface and also the extent to which the pile is cooled as it is withdrawn from the surface as is described in UK patent application specification Nos. 1451311, 1451312 and 1451313. As is described therein the material is preferably withdrawn form the heated surface over a suitably shaped roll.

The process of the present invention is applicable to all thermoplastic materials but the temperature of the hot surface used for pile formation depends upon the nature of the material. The choice of thermoplastic material will depend upon the use to which the pile surfaced material is to be put but we have found particularly pleasing products may be obtained using polymers and copolymer of olefines such as polyethylene, polypropylene, ethylene propylene copolymers and with polymers and copolymers of vinyl chloride, polymers and copolymers of styrene, polyesters such as polyethylene terephthalate and the various polyamides together with any other well known thermoplastic materials. The thermoplastic material may be supplied as an already formed film either direct from an extruder or from a reel of film that may be coated by for instance extrusion coating directly onto the backing material.

The backing substrate layer may be of any suitable material providing it may be bonded to the thermoplastic material and can withstand the processing techniques of the present invention; examples of particularly suitable materials include woven and nonwoven textile webs such as hessian, cotton net, glass fibre scrims and linen scrims, alternatively the substrate may be of paper or metal or cardboard and may have holes formed therein to aid the adhesion between the substrate and the thermoplastic material. It is therefore important that the nature of the backing material is such that it is unaffected by the temperature used in the present invention.

The pile surfaced material may be heated in accordance with the present invention in any suitable manner but the heat source is not in contact with the pile or preferably with the material; preferred methods are to pass the material through a heated oven either freely suspended or on a support such as a continuous belt; the process may be an extension to the process in which the pile surface is formed. Thus, in a preferred process for the production of pile surfaced material from a sheet of thermoplastic and backing material a film of the thermoplastic material together with the backing material are first fed to a heated roll and the two pressed against the surface of the heated roll by a pressure backing roll or tension in the backing material in such a way that the thermoplastic material is adjacent to the surface of the heated roll and, after passage around part of the circumference of the roll, the two are separated from the surface of the roll. The temperature of the surface of the heated roll is such that the film of thermoplastic material is melted so that one side is bonded to the backing substrate and the other side adheres to the surface of the roll so that fibrils are drawn out from this side as the thermoplastic separates from the hot roll, the fibrils being cooled as they are drawn out. In a preferred embodiment the sheet is withdrawn from the heated roll over a bar which controls the angle at which the material is withdrawn and a cooling fluid such as cold air is blown into the nip formed between the thermoplastic and the heated surface as the two separate.

The pile surfaced laminate obtained by the process described above may then be subjected directly to the techniques of the present invention and in a preferred process the pile surfaced laminate is passed from the pile forming process described above through a heated oven for sufficient time, to give the increased depth of the pile. The time during which the pile surfaced material is in the heating zone may be readily controlled by adjustment of the relative speeds of travel of the material having regard to the polymer and the temperature of the heated zone. The temperature at which the heating zone should be held depends upon three factors, the nature of the thermoplastic, the nature and thickness of the pile, and the time for which the material is heated. However, it has been found that the heating zone should generally be at a temperature between the glass transition temperature of the thermoplastic (but above ambient temperature) and the temperature at which the pile collapses. However, it must be appreciated that the optimum conditions may readily be determined by trial and error.

Before the product is further processed after it has been heated in accordance with the present invention it should be cooled to ambient temperature to avoid damaging the pile. If the product travels some distance after such heating this may be sufficient to achieve the necessary cooling but if not cold air from jets may conveniently be blown onto the pile surface.

The present invention is illustrated by reference to the accompanying drawing which shows a web of thermoplastic material 1 and a backing material 2 being fed via a feed roll 3 around a heated roll 4 in such a way that the thermoplastic material is against the surface of the heated roll. The thermoplastic material and the backing material pass around a considerable portion of the roll and are held against the roll by feed roll 3 and the resilient pressure roll 5. The laminate of the thermoplastic and the backing material thus formed is peeled away from the surface of the roll over the bar 6 and cold air is directed from the jet 7 onto the web as it is being peeled away from the hot roll to set the fibres which are drawn out from the surface of the sheet and ensure that they remain integral with the thermoplastic material. The pile surfaced web then passes from the heated roll into heating zone 8 and it has been found that the presence of the heating zone considerably increases the depth of the pile as compared with similar fabrics produced without the presence of the heating zone. In an alternative embodiment, warm air was blown onto the pile surface instead of passing the product through heating zone 8; the same effect was found.

The process of the present invention is further illustrated by reference to the following examples:

EXAMPLE 1

Pile surfaced materials were prepared using a variety of backing layers as follows:

Backing layer was fed to a nip between a roll heated to a temperature of 180° C. and having a substantially smooth surface and an unheated resilient backing roll. Low density polyethylene film was fed at the same rate between the backing layer and the heated roll. The contact time of the backing and film on the hot roll was approximately 30 seconds, and during this time the backing and film were held in contact with the hot roll by pressure applied by the resilient backing roll. The backing was parted from the hot roll and a blast of air at ambient temperature, 30 p.s.i., was directed at the side of the sheet nearest to the hot roll, thereby forming on the backing a soft pile of polyethylene fibrils. The pile surfaced material so formed was rolled up on lengths of 30 m having initial diameter 15 cm. Samples were taken from the outer and inner layers of the rolls and pile height measured before and after treatment according to the present invention. Said treatment comprised heating for 2 mins at 90° C. by placing said samples in an oven on a plate with the pile surface uppermost. The pile height was taken as height of pile excluding random pile peaks (average) and as height of pile including pile peaks (max); the pile heights do not include the thickness of the backing The results are presented in the following table:

| Backing | Polyethylene | Pile Height (mm) Before Treatment Average | Before Treatment Max. | After Treatment Average | After Treatment Max. |
|---|---|---|---|---|---|
| Paper (70gm$^{-2}$) | 1 Ply (65μm) | | | | |
| | Outer layer | 1.6 | 1.8 | 1.8 | 2.0 |
| | Inner layer | 0.6 | 1.0 | 1.6 | 1.9 |
| Paper (120gm$^{-2}$) | 2 Ply (each 75μm) | | | | |
| | Inner layer | 1.3 | 1.5 | 2.6 | 3.3 |
| | Outer layer | 2.0 | 2.5 | 6.5 | 7.2 |
| Paper (130gm$^{-2}$) | 1 Ply (65μm) | | | | |
| | Outer layer | 1.4 | 1.6 | 1.5 | 1.7 |
| | Inner layer | 0.6 | 0.7 | 1.3 | 1.5 |
| Non-woven cellulose | 1 Ply (65μm) | | | | |
| | Outer layer | 1.7 | 1.8 | 1.7* | 1.8* |
| | Inner layer | 1.3 | 1.4 | 1.6 | 1.8 |

*Improvements in colour saturation

The results show that pile height is increased during the process of the present invention and that material from inner layers of a roll are at least partially restored from pancaking.

EXAMPLE 2

An envelope was prepared, from a sample of pile-surfaced material described in Example 1 having paper (120 gm$^{-2}$) backing, using the method described in British patent specification No. 1393091. In this method, two rectangular pieces of pile-surfaced material, one piece measuring 20 cm×11 cm and the other 17 cm×11 cm, were superimposed with pile-surface in contact. The two longer edges and one short edge were heat sealed together to form an envelope, the non heat-sealed edge being left open to form (with the longer piece) a flap. The envelope was placed in an oven for about 10 seconds at 85° C. After removal from the oven and cooling to ambient temperature, the pile was found to have increased height, resulting in an envelope having firmer feel and greater shock protection and insulation for articles packaged therein.

The same effect was found in envelopes made in a continuous process wherein the two pieces are superimposed, parallel edge-sealed, heated in accordance with the present invention and single end edge heat-sealed.

EXAMPLE 3

A series of experiments were made to investigate the effect of temperature and time on the inner layer sample of Example 1 having a pile made from low density polyethylene and a backing of paper (70 gm$^{-2}$). Pieces from the sample were placed on a plate (pile uppermost) in an oven for a range of times and temperatures followed by cooling to ambient temperature. The oven was an air circulating electric oven controlled by a nickel-chrome thermo couple. The results below give average pile height (cm) opposite each exposure combination of time and temperature.

(a) Inner layer

Average initial pile height 0.95 cm

| | | Exposure time (s) 15 | 30 | 60 | 120 | 180 | 300 |
|---|---|---|---|---|---|---|---|
| Oven temperature | 45 | | 1.58 | | | | |
| | 60 | | 1.82 | 1.89 | 1.94 | | 1.85 |

-continued

| | | Exposure time (s) 15 | 30 | 60 | 120 | 180 | 300 |
|---|---|---|---|---|---|---|---|
| (°C.) | 80 | | 2.12 | 2.15 | 2.06 | | 2.07 |
| | 90 | | 2.04 | 2.23 | 2.22 | | 2.07 |
| | 95 | | 2.16 | | | | |
| | 100 | 2.00 | 2.08 | 1.81 | 1.56 | 0.97 | 0.48 |
| | 110 | 1.99 | 2.05 | 0.80 | | | |
| | 120 | 2.09 | | | | | |

The results are presented in FIG. 1, the area enclosed by ABCDEF being those exposure combinations falling within the scope of the present invention for the given material, with a minimum exposure time of 5 s (line AB).

(b) Outer layer

Average initial pile height 2.00 cm

| | | Exposure time (s) 15 | 30 | 45 | 60 | 120 | 180 | 300 |
|---|---|---|---|---|---|---|---|---|
| Oven Temperature (°C.) | 60 | | 1.90 | 1.84 | | 1.91 | | 2.02 |
| | 80 | | 2.16 | | 2.14 | 2.20 | | 2.22 |
| | 90 | | 2.22 | | 2.12 | 2.33 | | 2.12 |
| | 95 | | 2.22 | | | | | |
| | 100 | 2.35 | 2.08 | 2.31 | 1.88 | 1.56 | 0.97 | 0.33 |
| | 110 | 2.15 | 1.54 | | 0.44 | | | |
| | 120 | 2.12 | | | | | | |

Figure 2:
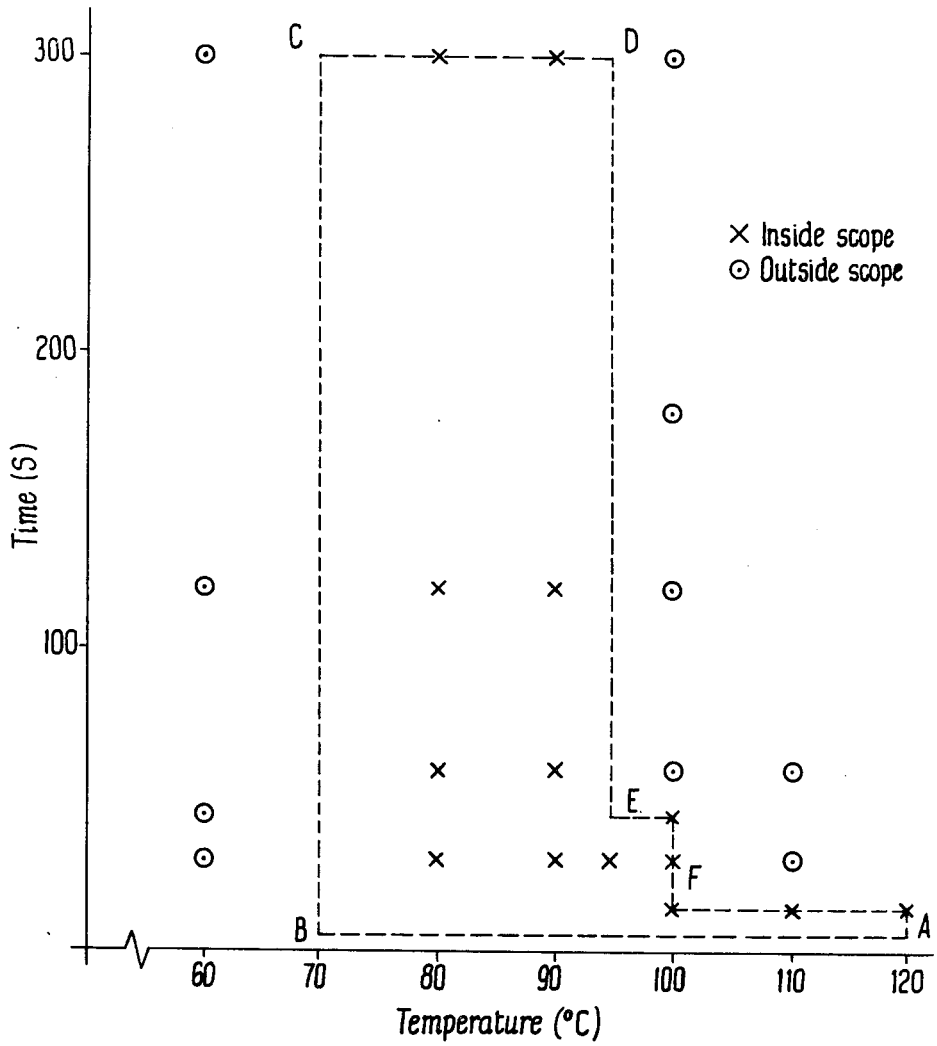
FIG. 2 is a graph showing time and temperature exposure combinations falling within the scope of the present invention for a sample taken from the outer layers of the rolled pile of example 1.
Figure 3:
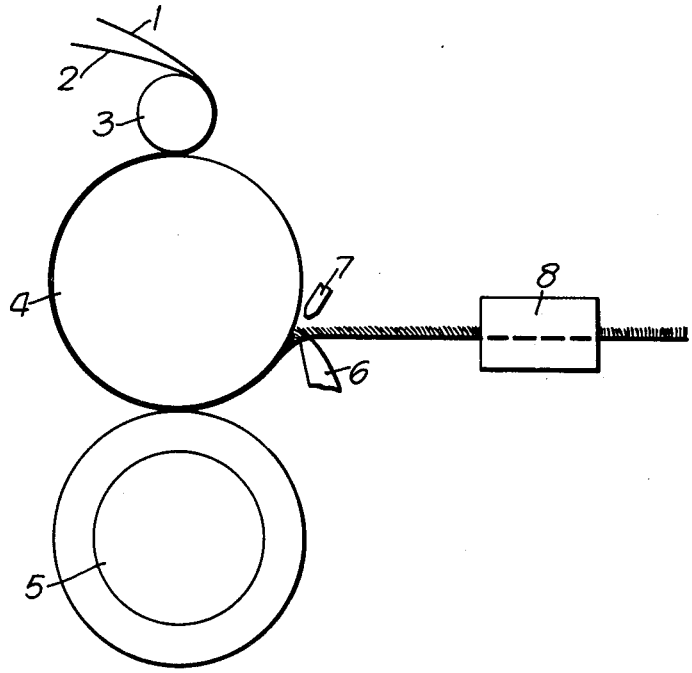
FIG. 3 illustrates a tack-spinning process with post heating step according to the present invention.

The results are presented in FIG. 2, the area enclosed by ABCDEF being those exposure combinations falling within the scope of the present invention for the given material, with a minimum exposure time of 5 s (line AB).

I claim:

1. A method for increasing the depth of the pile of a pile-surfaced product made by a tack-spinning process, the product having a pile of thermoplastic material on a backing layer, said method comprising space heating the pile side of the product without any mechanical buffing for a time and temperature less than that at which the pile collapses, said product being free of liquid treating agents, said temperature being between the glass rubber transition temperature but above ambient and the temperature at which the pile collapses, using a heat source not in contact with the pile, and subsequently cooling the pile to ambient temperature.

2. A process as claimed in claim 1 in which the heat source is warmed air.

3. A process as claimed in claim 1 in which the heat source is radiant heat.

4. A process according to claim 1 in which the product is freely suspended in the area of the heat source.

5. A process according to claim 1 in which the product is supported in the area of the heat source.

6. A process according to claim 1 in which the cooling is effected by air blown over the pile.

7. A process according to claim 1 including the step of tack-spinning the pile product.

8. A process as in claim 1 wherein said heating is carried out by placing the tack-spun product in an oven.

9. A process according to claim 1 in which the thermoplastic material from which the pile is formed is low density polyethylene.

10. A process according to claim 9 in which the product is heated at a temperature and for a time within the curve ABCDEF of the graph of FIG. 1.

11. A process according to claim 8 in which the product is heated at a temperature and for a time within the curve ABCDEF of the graph of FIG. 2.

* * * * *